US005478614A

United States Patent [19]

Morgan et al.

[11] Patent Number: 5,478,614

[45] Date of Patent: Dec. 26, 1995

[54] INFRARED SENSITIVE RECORDING MEDIUM WITH FLUOROCARBON SURFACTANT

[75] Inventors: David A. Morgan, Stillwater; Jon A. Bjork, Cottage Grove, both of Minn.

[73] Assignee: Minnesota Mining and Manufacturing Company, St. Paul, Minn.

[21] Appl. No.: 319,934

[22] Filed: Oct. 7, 1994

[51] Int. Cl.[6] ..... B41M 5/00

[52] U.S. Cl. ..... 428/29; 428/195; 428/206; 428/331; 428/913; 428/914; 430/9; 430/17; 430/110; 430/291; 430/944; 430/945; 430/964; 430/965

[58] Field of Search ..... 428/195, 206, 428/331, 913, 914, 29; 430/110, 291, 944, 964, 965, 9, 945, 17, 18

[56] References Cited

U.S. PATENT DOCUMENTS

| | | | |
|---|---|---|---|
| 3,941,596 | 3/1976 | Heiart | 156/234 |
| 4,139,483 | 2/1979 | Williams et al. | 252/62.1 P |
| 4,265,993 | 5/1981 | Mammino | 430/107 |
| 4,608,329 | 8/1986 | Geisler | 430/110 |
| 4,683,191 | 7/1987 | Geisler | 430/291 |
| 4,755,396 | 7/1988 | Geisler et al. | 427/197 |
| 4,968,578 | 11/1990 | Light et al. | 430/126 |
| 5,286,604 | 2/1994 | Simmons, III | 430/286 |

FOREIGN PATENT DOCUMENTS

| | | | |
|---|---|---|---|
| 4-22979 | 1/1992 | Japan | 428/195 |

*Primary Examiner*—B. Hamilton Hess
*Attorney, Agent, or Firm*—Gary L. Griswold; Walter N. Kirn; Mark A. Litman

[57] ABSTRACT

A radiation thermally imageable, solid toner addressable article comprises a substrate having on at least one surface thereof a layer comprising a) a solid binder which can be converted to a supercooled liquid upon heating and subsequent cooling to room temperature, b) a dye which absorbs radiation (at the wavelength of the imaging device,, e.e., ultraviolet, visible [especially the red], and infrared wavelengths) and converts infrared radiation to thermal energy, and c) a fluorinated surfactant. A directly thermally addressable article does not require the radiation absorbable dye.

10 Claims, No Drawings

INFRARED SENSITIVE RECORDING MEDIUM WITH FLUOROCARBON SURFACTANT

BACKGROUND OF THE INVENTION

1. Field of the Invention

The present invention relates to thermal imageable toner developed media, and particularly to such media which is addressed by coherent radiation such as lasers or light emitting diodes.

2. Background of the Art

There are numerous processes where images can be formed by causing a radiation-sensitive or heat-sensitive layer to become tacky or fluid in imaged areas and then developed by the application of powder or liquid to the tacky or fluid areas. An example of such a process is disclosed in U.S. Pat. No. 3,941,596.

It has to date been conventional practice for the imaging to be performed by thermal printheads, with the imagewise applied heat being used to create latent images of tackified or fluid composition on the imageable surface. Such physically contacting thermal printheads suffer from a number of problems including significant limitations on the resolution of the image (effectively limited to the physical size of the individual printheads) and adherence of matter from the receptor sheet onto the printheads. A solution to this latter problem is suggested in U.S. Pat. No. 4,755,396 where antifouling agents are included in the receiving medium. Amongst the antifouling agents disclosed are fluorocarbon polymers.

U.S. Pat. Nos. 4,608,329 and 4,683,191 disclose improved toner powders for use with thermally imageable media which produce supercooled liquid area from solid materials during the thermal imaging process. These supercooled liquid areas absorb the toner powders more readily than the solid areas and thereby differentiate the image.

U.S. Pat. No. 4,968,578 discloses a method of non-electrostatic transfer of toner powder to a substrate having a polymeric coating layer and a release layer over the polymeric coating. Perfluorinated release agents are included amongst the disclosed release layer materials, and the image is formed before transfer to the receptor without creating differential adherent properties on the surface of the receptor.

U.S. Pat. No. 5,286,604 discloses a photothermotackifiable composition which is addressable by lasers. The composition contains an infrared absorbing dye to assure effective radiation absorption and heat conversion by the infrared laser addressing equipment. Toning systems are also disclosed for the media containing the composition.

SUMMARY OF THE INVENTION

The present invention relates to radiation addressable thermal imaging, or purely thermal imaging, latent image tonable systems in which the thermally sensitive receptor sheet comprises a substrate having on at least one surface thereof a composition which when thermally imaged produces local areas which are more soluble towards solid toners, the composition comprising a material capable of existing at room temperature in a supercooled state after melting and subsequent cooling, an infrared radiation absorbing dye which absorbs infrared radiation and converts at least a portion of that radiation to heat (in the laser addressable or radiation addressable imaging system only), and a fluorinated surfactant. The fluorinated surfactant has been found to improve image differentiation by reducing the amount of toner which adheres to non-imaged, non-supercooled areas.

DETAILED DESCRIPTION OF THE INVENTION

The material capable of existing in a supercooled state after melting and subsequent cooling, hereinafter referred to as supercooling material, must have a melting temperature about 10° C. above ambient temperature. Ambient temperature, as used herein, refers to the temperature of the environment wherein the imaging process is conducted (e.g., room temperature of about 19° C. to 20° C.). The material of the coating must also form a supercooled melt when cooled to a temperature below its melting temperature, i.e. these materials exist, at least temporarily, as fluid metastable liquids after being melted and then cooled below their melting temperatures. When the latent image has been formed, it should wet the surface of the substrate. Moreover, the image must remain fluid and in place until it is contacted with (i.e., developed by) the dry imaging powder. Alternatively, it may be allowed to cool below its melting point to form a supercooled melt before the image areas are developed. Because the supercooled liquid has not regained its solid state, the material retains sufficient memory in the imaged areas to be developed and fixed. Once the material regains its solid state in the imaged areas, the latent image ceases to exist as a distinct area.

Preferably, the supercooling material melts within the approximate range of 40° C. to 140° C. Due to the lack in the available chemical literature of adequate data for defining the supercooling materials useful in the practice of the invention, definitive test procedures have been established, one which will now be described.

The melting point or melting range of the supercooling material is determined, for the purposes of this invention, by placing a small amount of the material in powder form on a glass microscope slide, covering the sample with a cover glass, heating the material on a microscope having a hot stage which is provided with temperature measuring means, and observing the temperature at which the particles melt and fuse.

A test for determining if a material is a supercooling material suitable for this invention is conveniently accomplished using the same sample as for the melting point test. A Leitz hot stage microscope having an electrically heated stage which may be cooled by circulation of cold water is used for both determinations. After the stage has been heated above the melting point of the sample, it is cooled and the temperature noted at which crystallization or solidification occurs. Both heating and cooling may be accomplished at somewhat higher rates of temperature change than are ordinarily specified where more precise measurements are required. Materials which when thus treated remain liquid to a temperature well below their melting points, e.g., at least about 60° C. below their melting points, have been found to be effective as supercooling materials for this invention; materials which crystallize or solidify at or near their melting points should not be used for making powder-retaining latent images in accordance with this invention. Some materials solidify to a glassy rather than a visibly crystalline state, a condition which is easily determined by applying moderate pressure on the cover glass with a spatula; glassy droplets retain their shape, whereas the liquid droplets flow or rapidly crystallize. A more elaborate test for determination of supercooling materials suitable for this invention is described in U.S. Pat. No. 3,360,367, incorporated herein by reference.

A number of supercooling materials are useful in the coatings of the invention. Representative examples of these materials include dicyclohexyl phthalate, diphenyl phthalate, triphenyl phosphate, dimethyl fumurate, benzotriazole, 2,4-dihydroxy benzophenone, tribenzylamine, benzil, vanillin, and phthalophenone. Another useful material of this type is "Santicizer 9", a mixture of ortho- and para-toluene sulfonamides commercially available from the Monsanto Chemical Company. Mixtures of these materials are also useful. The supercooling material can also consist of two or more materials that are not supercooling by themselves, but are recombinable to form a supercooling material.

The compositions of the invention preferably comprise at least 60% supercooling material, and at least 0.025% by weight of said supercooling material of fluorinated surfactant. When absorbing dyes are used, they should comprise at least 0.00025 wt. % solids of the layer. Inert binders, particulates coating aids, and other adjuvants may also be present. The supercoolant material is usually present between 60–99.5 % solids, more preferably between 75–99.5% solids, the superfactant as 0.025–7%, preferably as 0.025–5%, and more preferably as 0.05 to 3% by weight solids in the layer. The absorbing dye is generally present as 0.00025 to 2% by weight, more preferably or 0.0005 to 1.5% by weight of said dry layer.

Infrared absorbing dyes which convert infrared radiation to heat or other wavelength absorbing dyes which can convert radiation to heat are well known in the art and are widely available commercially. Merocyanine, cyanine, and tricarbocyanine dyes are the most readily available generic classes of infrared absorbing dyes, and those within those classes in the heptamethine series, and oxazoles, benzoxazoles, 2-quinolines, 4-quinolines, benzothiazoles, indolinenes, thiazoles, squariliums, etc. tend to be the most preferred. It is particularly desirable that the infrared absorbing dyes have minimum absorbance within the visible spectrum as such absorption increases the color density of the background (or background fog) for the final image. This is usually undesirable in higher quality imaging systems. Dyes of these types may be found in the general literature such as *The Theory of the Photographic Process,* Mees and James, Third Edition, 1996; *Cyanine Dyes,* Venkataraman, 2d Edition, 1963; and extensively in patent literature such as U.S. Pat. Nos. 5,041,550, 4,784,933, 3,194,805, 4,619,892, 5,013,622, and 5,245,045. Essentially any dye which efficiently absorbs infrared radiation and converts it to heat can be used in the practice of the present invention. Efficiency is merely a physical matter indicating that enough energy is absorbed and converted to heat to drive the process of melting the composition. With higher energy imaging sources (e.g., gas lasers), the efficiency can be much lower than with lower energy sources (e.g., light emitting diodes).

Fluorocarbon surfactants are materials well known in the art and are commercially available. These types of surfactants are widely reported in the patent literature, as for example in U.S. Pat. Nos. 2,759,019, 2,764,602, 3,589,906 and 3,884,699, Belgian Patent No. 739,245, and French Patent No. 2,025,688. These fluorinated surfactant compounds ordinarily comprise at least one highly fluorinated chain carried with an ionic or ionizable group although they may be nonionic in certain environments. A "highly fluorinated" group according to the practice of the present invention is a group wherein a substantial portion of hydrogen atoms attached to carbon atoms have been replaced with fluorine atoms. Preferably the highly fluorinated group contains an average of more than 1.75 fluorine atoms per carbon atom within a single chain on the compound. More preferably, remaining hydrogens on the chain (which have not been replaced with fluorine) are replaced by chlorine. More preferably, within an alkyl chain (including, but less preferably cycloalkyl) there are at least 2.0 fluorine atoms per carbon atom in the chain, and most preferably the group contains a perfluorinated alkyl chain. The perfluorinated group may be perfluoromethyl, perfluoroethyl, perfluoropropyl, perfluorobutyl, etc., preferably having five or more carbon atoms within each perfluorinated chain, with $C_5$–$C_{20}$ being preferred for the highly fluorinated groups. The fluorinated surfactant should be present in the composition of the invention as from 0.01 to 6% by weight solids of said layer, more preferably as 0.05 to 5% by weigh solids of said layer, and more preferably as 0.1 to 4% by weight solids.

The thermal imaging layer of the present invention may also contain particulate materials in the composition to prevent blocking between contacting elements. Matting agents such as silica, Acrylates (e.g., polymethylmethacrylate polymers and copolymer beads), polystyrene, titania, polytetrafluoroethylene and the like may be used for this purpose. Even white pigments may be used as this can provide a brighter background for the deposition of the toner. The matting agents should roughen the surface of the composition and can provide the additional function of dispersing the coherent radiation, thereby reducing fringes and other optical effects associated with lasers. These particulates may be present in amounts from 0.01 to 7.5% by weight of the composition layer, preferably in an amount of from 0.1 to 5% by weight solids of that layer.

These and other aspects of the present invention will become apparent from the following, non-limiting examples.

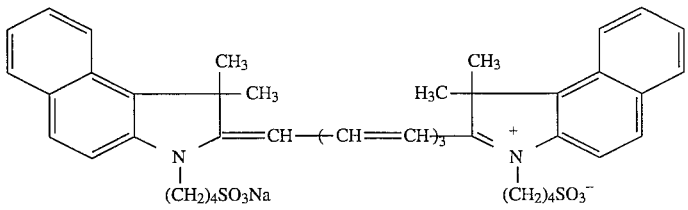

IR 125

IR 125 is commercially available from Eastman Kodak Co., Rochester, N.Y.

EXAMPLE 1

The following ingredients were combined and mixed with a high shear mixer to form a homogenous dispersion:

| | |
|---|---|
| Acetone | 73.4 g |
| Ethocel N200 (ethylcellulose resin, available from Dow Chemical) | 3.0 g |
| Dicyclohexylphthalate | 23.0 g |
| FC-431 (fluorochemical surfactant, available from 3M Company) | 0.3 g |
| Syloid 74 (silicon dioxide, available from W. R. Grace) | 0.3 g |
| IR-125 Dye | 0.004 g |

The dispersion was coated onto supercalendered paper at 0.7 g/ft$^2$ (7.5 g/m$^2$) wet thickness, air dried and then allowed to crystallize, by letting the sample stand for 3–5 days. After crystallization the sample was imaged with a 700 milliwatt 826nm fiber coupled laser diode (Model 2361-P2, available from Spectro Diode Labs) at 4 mm/sec. The image was then visualized by application of a black dry magnetic copier toner (3M Type 471 pressure fix toner) to give a crisp black image on a white background.

EXAMPLE 2

The following ingredients were combined and mixed with a high shear mixer to form a homogenous dispersion:

| | |
|---|---|
| Acetone | 69.2 g |
| Ethocel N200 (ethylcellulose resin, available from Dow Chemical) | 2.6 g |
| Dicyclohexylphthalate | 25.4 g |
| Fluo HT (micronized polytetrafluoroethylene available from Micro Powders, Inc.) | 2.8 g |
| FC-431 (fluorochemical surfactant, available from 3M Company) | 0.1 g |

The dispersion was coated onto supercalendered paper at 0.4 g/ft$^2$ (4.3 g/m$^2$) wet thickness, air dried and allowed to crystallize, by letting the sample stand for 3–5 days. A second sample without the addition of the FC-431 was prepared using the same procedure, which took much longer to crystallize. This shows that the presence of a surfactant reduced the crystallization time. Both samples were imaged with heat using a Monarch 9402 thermal barcode printer (available from Monarch Marking) at the mid contrast setting. The latent image on both samples was developed with black dry magnetic copier toner (3M Type 471 pressure fix toner) using a magnetic brush. The sample with the FC-431 fluorochemical surfactant gave rise to a clean background having a 0.04 optical density (Dmin). The sample omitting the FC-431 fluorochemical surfactant gave rise to a background having a 0.24 optical density. The optical densities were measured using a MacBeth TR924 densitometer using a visual filter.

What is claimed:

1. A thermally imageable, solid toner addressable article comprising a substrate having on at least one surface thereof a layer comprising a) a solid binder which can be converted to a supercooled liquid upon heating and subsequent cooling to room temperature, b) a dye which absorbs infrared radiation and converts infrared radiation to thermal energy, and c) a fluorinated surfactant.

2. The article of claim 1 wherein said layer also contains matting agent.

3. The article of claim 2 wherein said matting agent comprises from 0.01 to 7.5% by weight solids of said layer.

4. The article of claim 3 wherein said matting agent comprises silica.

5. The article of claim 1 wherein said fluorinated surfactant comprises a perfluorinated alkyl group bonded to an ionic group.

6. The article of claim 1 wherein said solid binder comprises toluene sulfonamides.

7. The article of claim 1 wherein said solid binder comprises a material selected from the group consisting of dicyclohexyl phthalate, triphenylphosphate, dimethylfumarate, benzotriazole, 2,4-dihydroxybenzophenone, tribenzylamine, benzil, vanillin, and phthalophenone.

8. A thermally imageable, solid toner thermally addressable article comprising a substrate having on at least one surface thereof a layer comprising a) a solid binder which can be converted to a supercooled liquid upon heating and subsequent cooling to room temperature, and b) a fluorinated surfactant.

9. The article of claim 8 wherein said fluorinated surfactant comprises a highly fluorinated alkyl group bonded to an ionic group.

10. The article of claim 9 wherein said higly fluorinated group is a perfluorinated alkyl group.

* * * * *